US005202674A

United States Patent [19]

Takemori et al.

[11] Patent Number: 5,202,674

[45] Date of Patent: Apr. 13, 1993

[54] APPARATUS FOR AND METHOD OF DRIVING ELECTRODES OF FLAT DISPLAY

[75] Inventors: Daisuke Takemori, Suita; Katsumi Terada, Tuzuki, both of Japan

[73] Assignee: Sanyo Electric Co., Ltd., Osaka, Japan

[21] Appl. No.: 677,053

[22] Filed: Mar. 29, 1991

[30] Foreign Application Priority Data

Mar. 30, 1990 [JP] Japan ..... 2-87147

[51] Int. Cl.[5] ..... G09G 3/30

[52] U.S. Cl. ..... 340/781; 313/422

[58] Field of Search ..... 340/781, 780, 763, 772, 340/789, 805; 315/169.1, 169.2, 169.3, 366; 313/422, 421; 358/56

[56] References Cited

U.S. PATENT DOCUMENTS

| | | | |
|---|---|---|---|
| 3,634,714 | 1/1972 | Anderson et al. | 340/781 |
| 4,158,210 | 6/1979 | Watanabe et al. | 358/56 |
| 4,227,117 | 10/1980 | Watanabe et al. | 313/422 |
| 4,531,122 | 7/1985 | Redfield | 340/781 |
| 4,719,388 | 1/1988 | Oess | 313/422 |
| 4,868,555 | 9/1989 | Watanabe et al. | 340/780 |
| 4,973,889 | 11/1990 | Tomii et al. | 315/366 |

*Primary Examiner*—Ulysses Weldon
*Assistant Examiner*—Xiao M. Wu
*Attorney, Agent, or Firm*—Armstrong, Westerman, Hattori, McLeland & Naughton

[57] ABSTRACT

In a flat display having data-side address electrodes and scanning-side address electrodes arranged in the form of an XY matrix on the respective surfaces of a board, an apparatus for and a method of driving the electrodes by applying a horizontal scanning signal to the scanning-side electrodes successively, applying an image signal to every other data-side address electrode, applying a correction voltage signal of a specified fixed voltage value to the electrodes on opposite sides of each address electrode receiving the image signal, and alternately applying the image signal and the correction signal as replaced by each other to the data-side address electrodes for every scan.

4 Claims, 6 Drawing Sheets

SEE FIG. 1b
SEE FIG. 1c
SEE FIG. 1d
1
10
11
12
43
45
4
46
5
50
21
23
24
30
20
2
3
40
41
42
44

APPARATUS FOR AND METHOD OF DRIVING ELECTRODES OF FLAT DISPLAY

FIELD OF INDUSTRIAL APPLICATION

The present invention relates to an apparatus for and a method of driving the electrodes of a flat display wherein the phosphor dots on a display panel are excited by electron beams to display images.

BACKGROUND OF THE INVENTION

As display devices, those of the CRT type wherein phosphors are irradiated with high-speed electron beams for excitation are the most excellent from the viewpoint of the quality of images. However, television sets of the CRT type, when having a large screen, exceed 170 kg in weight and 850 mm in depth and are therefore not acceptable generally for household use.

Accordingly, flat displays of the electron beam type are proposed in U.S. Pat. No. 4,719,388 or Unexamined Japanese Patent Publication SHO 61-242489, and like publication SHO 62-90831. The proposed displays have a cathode of linear filaments as an electron beam emitter and XY matrix electrodes for withdrawing high-speed electron beams, which are caused to impinge on a fluorescent screen at specified addresses.

With reference to FIGS. 1 and 2, the flat display comprises a front panel 1 having a fluorescent screen 10 on its rear surface, and a rear panel 2 having a back electrode 20 on its inner surface and defining a flat hermetic space together with the panel 1. An address electrode board 4 and a grid electrode 5 provided with a gridded surface 50 are arranged in the space in parallel to the panels. The address electrode board 4 comprises first address electrodes 42 arranged on one surface of a substrate 40 and extending in one direction of an XY matrix, and second address electrodes 44 arranged on the other surface of the substrate 40 and extending in a direction intersecting the first address electrodes 42 at right angles therewith. The points where the first address electrodes 42 intersect the second address electrodes are each formed with one or more than one aperture 41. The two groups of address electrodes of the display are controlled by electrode control-drive circuits 6, 7, respectively, as will be described later. When a positive voltage is applied to one selected second address electrodes 44 extending in X-direction and to the first address electrodes 42 extending in Y-direction at the same time, electron beams are drawn through the apertures 41 positioned at the points of intersection of these electrodes to irradiate the phosphor dots at the specified addresses on the fluorescent screen on the front panel 1 to which a high voltage is applied, causing the dots to luminesce.

Since the fluorescent screen of the flat display described is excited basically on the same principle as the CRT, the flat display of this type has the advantage of giving images of higher quality than flat displays of other types, such as the PDP (plasma display panel) type, LCD (liquid crystal display) type, VFT (fluorescent display tube) type, etc.

The luminance of the screen is increased by various contrivances, for example, by enlarging the apertures of the address electrode board 4 to pass larger quantities of beams therethrough, or by applying a higher voltage to the address electrodes 42, 44 to draw electrons from the cathode with greater ease.

FIG. 3 shows the configuration and arrangement of the address electrodes. For example, when the second address electrode 44 disposed on the cathode side are the scanning electrodes, the first address electrodes 42 arranged on the fluorescent screen side serve as data-side electrodes to which an image signal is applied.

The fluorescent screen 10 has phosphor dots 11 which are arranged usually in a delta pattern, and the apertures 41 are formed in corresponding relation to the respective dots.

With reference to FIG. 3, the second address electrodes 44 are represented one after another by $X_1, \ldots, X_n, X_{n+1}, \ldots$, and the first address electrodes 42 by $Y_1, \ldots, Y_m, Y_{m+1}, Y_{m+2}, Y_{m+3}, Y_{m+4}, \ldots$. As shown in FIG. 8, a scanning signal voltage 70 is applied to the second address electrode $X_n$ during one period H of horizontal scanning, whereupon the voltage is applied to the second address electrode $X_{n+1}$ during the next period H.

In the case where the image data signal is quantized and subjected to pulse-width modulation for the first address electrodes 42, the image data signal stored in a shift register and latch of the data-side electrode control-drive circuit 6 is subjected to pulse-width modulation and applied to the electrodes $Y_1, \ldots, Y_{m+4}, \ldots$ at the same time. At the points where the second address electrode $X_n$ with the horizontal scanning voltage applied thereto intersects the first address electrodes $Y_m$, $Y_{m+1}$, $Y_{m+4}$ and which include the apertures 41 on the electrode $X_n$, electron beams are drawn through the apertures 41 while being controlled to irradiate the corresponding phosphor dots.

With reference to FIG. 7 showing the fluorescent screen, the R, G, B phosphor dots 11 are arranged in a black matrix 13 in the delta pattern. When the electron beams are withdrawn straight, the beam spots 14 impinge on the respective dots 11 centrally thereof to produce a sharp image. As will be apparent from FIG. 3, however, during scanning with the nth second address electrode 44, i.e., electrode $X_n$, the image signal applied to the first address electrodes 42 acts effectively for the electrodes $Y_m$, $Y_{m+2}$, $Y_{m+4}$ in controlling the beams but ineffectively for the electrodes $Y_{m+1}$, $Y_{m+3}$ since no scanning voltage is applied to the second address electrode $X_{n+1}$ despite the impression of the image signal voltage on these first address electrodes. Conversely during the next horizontal scanning period, the first address electrodes $Y_{m+1}$, $Y_{m+3}$ become effective electrodes, and the electrodes $Y_m$, $Y_{m+2}$, $Y_{m+4}$ are ineffective.

Because the image signal is applied to the first address electrodes 42 at the same time regardless of the effectiveness, the electron beams drawn through the apertures 41 in the effective electrodes are deflected by being influenced by the image signal voltage on the ineffective electrodes as represented in FIG. 7 by beam spots 14A, 14B failing to fully strike on the phosphor dot and partly impinging on the black matrix, or by a beam spot 14C which is deformed. The deflection of electron beams entails the problem of producing images of lower luminance or reduced sharpness.

SUMMARY OF THE INVENTION

An object of the present invention is to provide an apparatus for and a method of driving the electrodes of a flat display so as to properly project electron beams on the phosphor dots and to produce images of higher luminance and improved sharpness.

Another object of the invention is provide an apparatus for and a method of driving the electrodes of a flat display, with a correction signal of a specified fixed value applied to those of the image data electrodes which become ineffective in connection with the scanning electrode, so as to produce images of higher luminance and improved sharpness.

In the apparatus and method embodying the invention, a scanning-side control-drive circuit is connected to the horizontal scanning-side electrodes of a flat display, and a data-side control-drive circuit and a correction signal circuit are connected to the data-side electrodes of the display. The correction signal circuit produces a correction signal fixed to a specified value. An image signal and the correction signal are alternately applied to the data-side electrodes upon a change-over.

In the above apparatus, those of the first address electrodes which are positioned to intersect apertures on the horizontal line of the second address electrode receiving a horizontal scanning voltage permit the image signal applied thereto to serve as effective data and to control electron beams. The correction signal from the correction signal circuit is applied to the first address electrodes on opposite sides of and adjacent to each of the effective electrodes. Since the signal is fixed to the specified value, the signal voltage is symmetrically in equilibrium on opposite sides of the effective electrode, consequently producing no influence on the electron beams.

In the next period of scanning, the image signal or the correction signal is applied to the first address electrodes alternatively to the signal previously applied thereto, and this procedure is thereafter repeated.

During each period of horizontal scanning, therefore, the correction signal of specified fixed value is applied to the first address electrodes not participating in the control of electron beams, symmetrically with respect to the electron beams, whereby the deflection of the beams can be precluded. Moreover, the voltage of the correction signal further facilitates the withdrawal of electron beams to give higher luminance to the images on the flat display.

DESCRIPTION OF THE PREFERRED EMBODIMENT

Figures 1A, 1B, 1C, 1D:
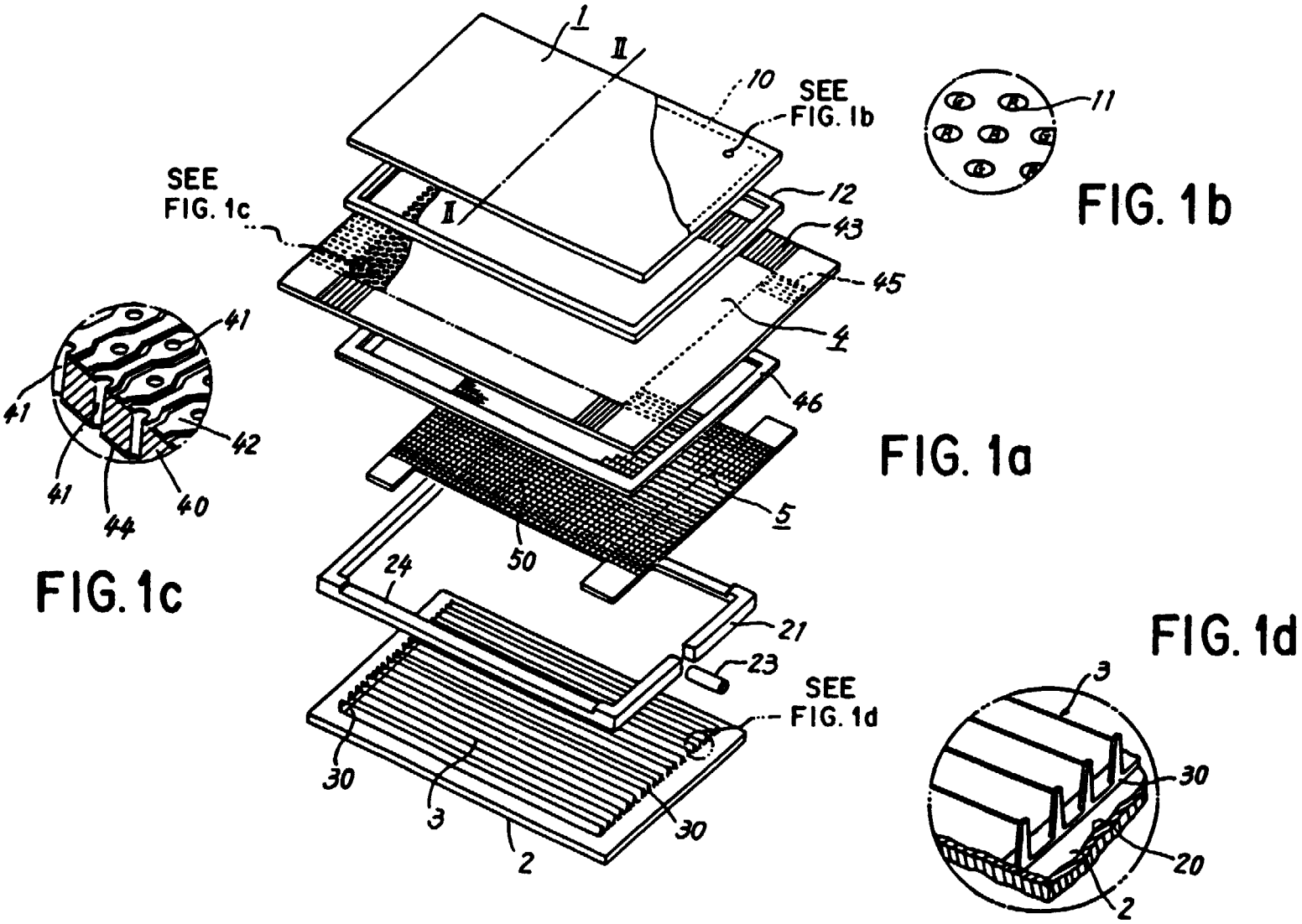
FIG. 1 is an exploded perspective view of a flat display.

FIG. 1 shows a flat color display which comprises a front panel 1, a rear panel 2, and an address electrode board 4 and a grid electrode 5 arranged between the two panels 1, 2 along with interposed glass frames 12, 46, 21. These components are joined together with frit glass, and the assembly is evacuated through an air discharge tube 23.

The front panel 1 is a large-sized panel measuring 880 mm in horizontal length, 497 mm in vertical length and 3 to 4 mm in thickness. As is already known, a fluorescent screen 10 is formed on the panel inner surface by regularly arranging phosphor dots 11 of three primary colors, i.e., red, blue and green, at a specified pitch over the entire area.

The rear panel 2 is in the form of a glass plate having a thickness of 3 to 4 mm and joined at its periphery to the inner surface of the front panel 1 to provide a display panel unit.

Disposed inside the rear panel 2 is a cathode 3 of linear filaments extending tautly and each held at its opposite ends by anchors 30, 30. The panel inner surface is covered with a metal film to provide a back electrode 20.

The address electrode board 4 comprises a glass or ceramic substrate 40, first address electrodes 42 extending in Y-direction (vertical direction) of an XY matrix on the substrate surface opposed to the front panel, arranged for the respective rows of phosphor dots present in this direction and adapted to control electron beams by an image data signal, and second address electrodes 44 extending on the other surface of the substrate 40 toward a direction intersecting the first address electrodes 42 at right angles therewith, arranged for the respective rows of phosphor dots present in this direction and adapted for horizontal scanning. The first address electrodes 42 extend in parallel and are 3143 in number in corresponding relation to the number of phosphor dots arranged horizontally on the front panel 1. The image data signal voltage, and the correction data signal voltage to be described later are applied to these electrodes. On the other hand, the second address electrodes 44 are arranged in parallel and are 1035 in number in corresponding relation to the number of phosphor dots arranged vertically. The voltage of an address signal is applied to these electrodes successively for vertical scanning.

Figure 2:
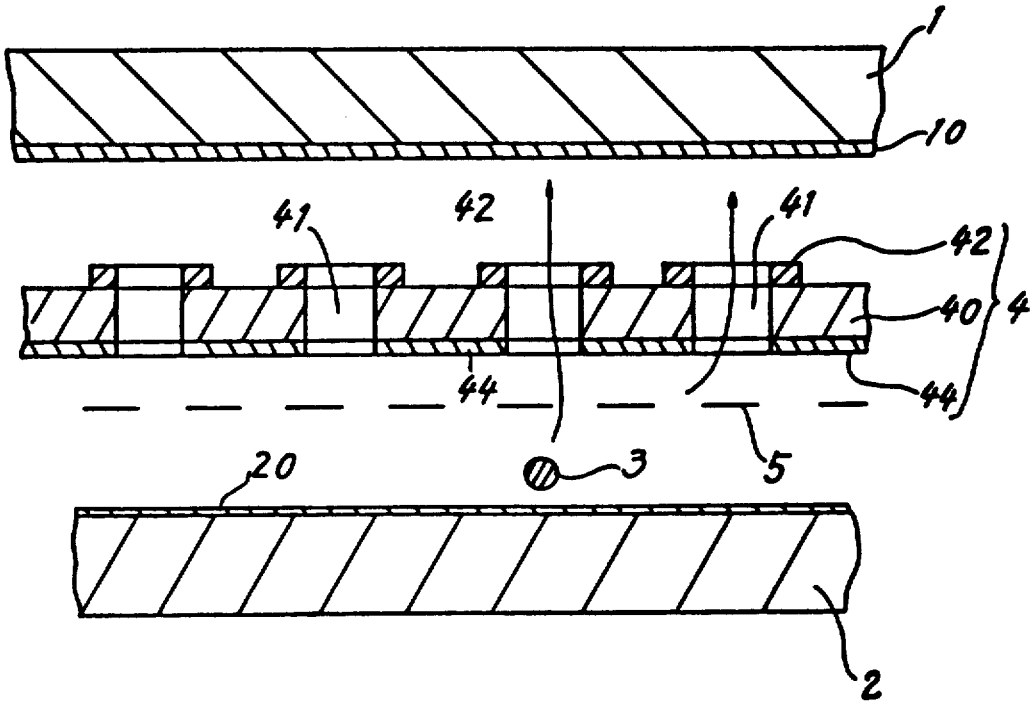
FIG.2 PRIOR ART
FIG. 2 is a fragmentary sectional view of the display showing an electron beam as deflected by the voltage of an image data signal applied to an ineffective electrode included in first address electrodes.

The intersections of both the electrodes 42, 44 are in coincidence with the respective phosphor dots in position. As shown in FIG. 2, at least one aperture 41 extending through the electrodes 42, 44 and the substrate 40 is formed at the position of each of the intersections over the entire area of the address electrode board 3.

Figure 5:
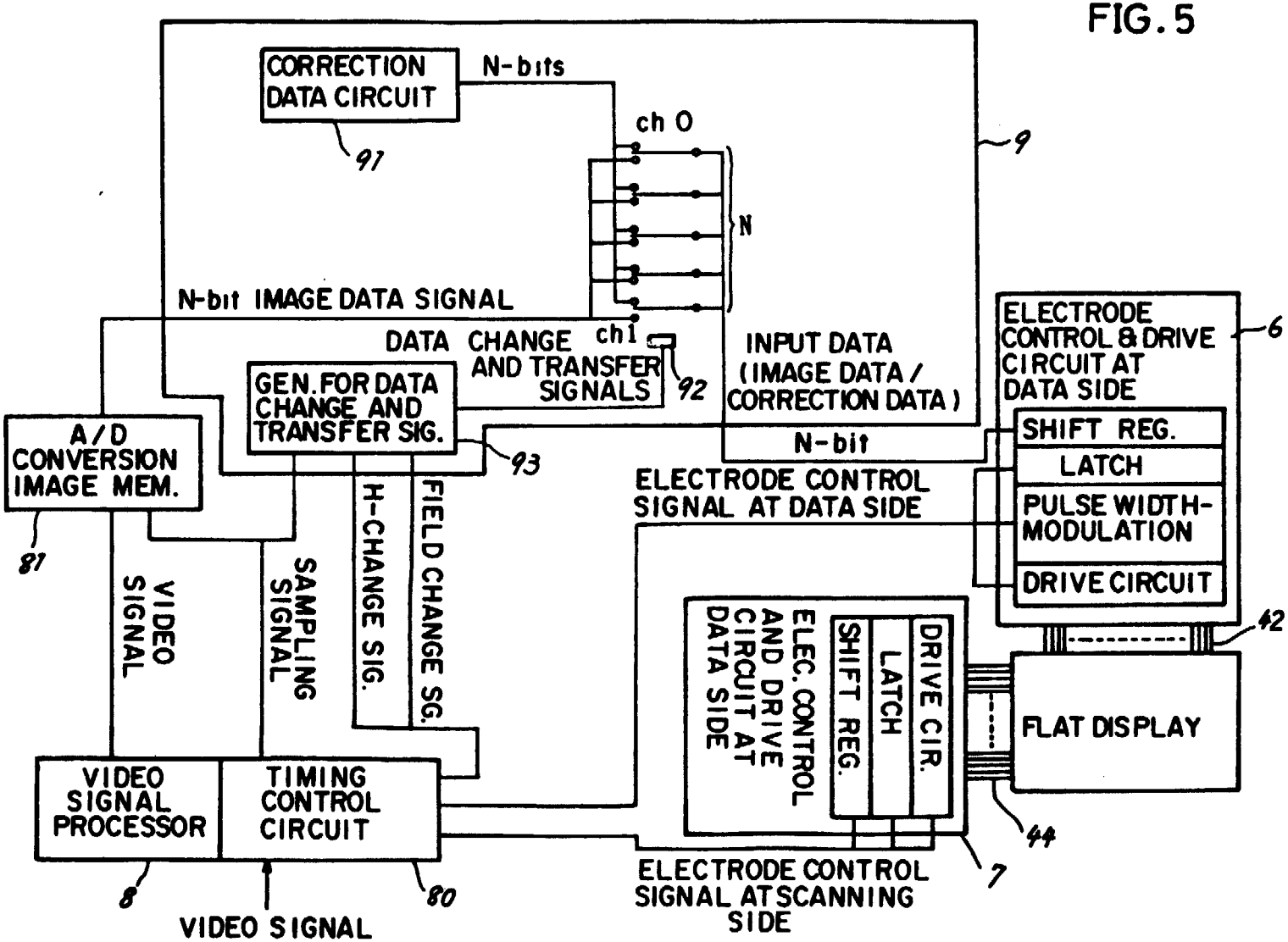
FIG. 5 is a diagram showing a circuit for driving the first and second address electrodes.

With reference to FIG. 5, a scanning-side electrode control-drive circuit 7 is connected to the second address electrodes 44 as already known to successively apply the scanning voltage to the electrodes 44 extending in X-direction.

A data-side electrode control-drive circuit 6 and a correction signal circuit 9 are connected to the first address electrodes 42, whereby the image data signal and the correction data signal are applied with the specified timing to the electrodes 42 extending in Y-direction.

Figure 4:
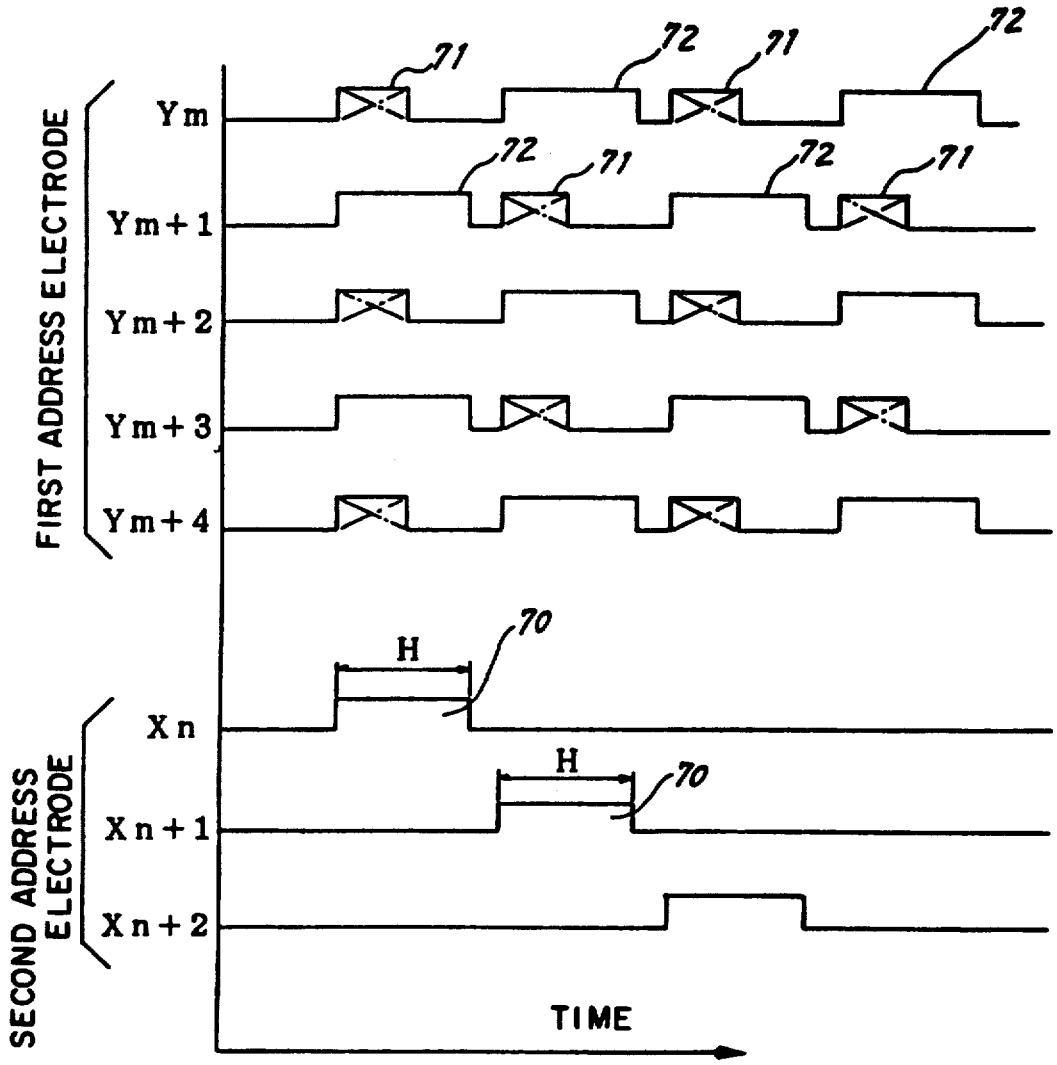
FIG. 4 is a diagram showing the signals to be applied to the first and second address electrodes.

The scanning-side control-drive circuit 7 comprises a shift register, latch and drive circuit, receives a control signal and applies a scanning signal 70 of specified potential with a horizontal period H as shown in FIG. 4 to the specified electrode in the group of second address electrodes 44. The electrode to be operated is changed over successively by the circuit 7.

The data-side electrode control-drive circuit 6 comprises a shift register, latch, pulse-width modulation circuit and drive circuit. The A/D converted image data signal 71 or correction data signal 72 to be applied to the first address electrodes 42 is fed to the shift register, subjected to pulse-width modulation or frequency modulation, and applied to the first address electrodes 42 as timed with the change-over of the second address electrode 44.

Figure 6:
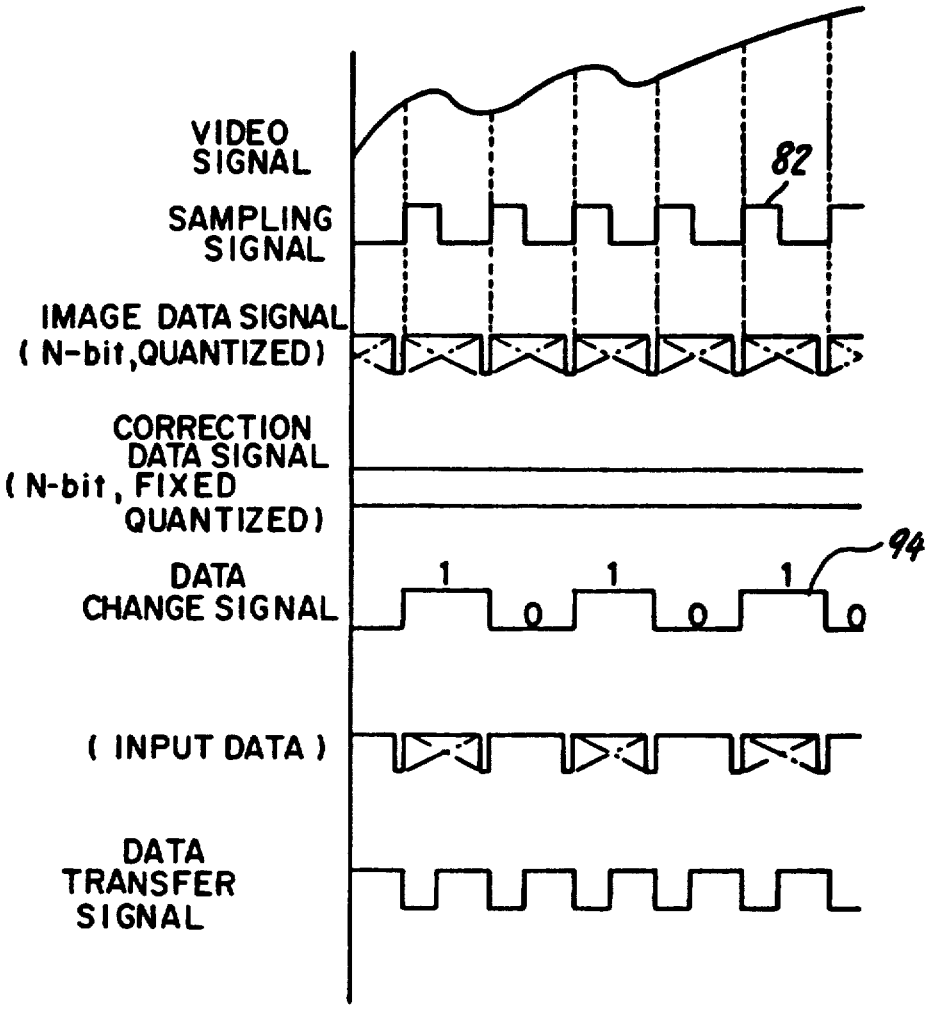
FIG. 6 is a diagram illustrating video signal processing and the waveform of a signal to be applied to a data-side electrode control-drive circuit.
Figure 7:
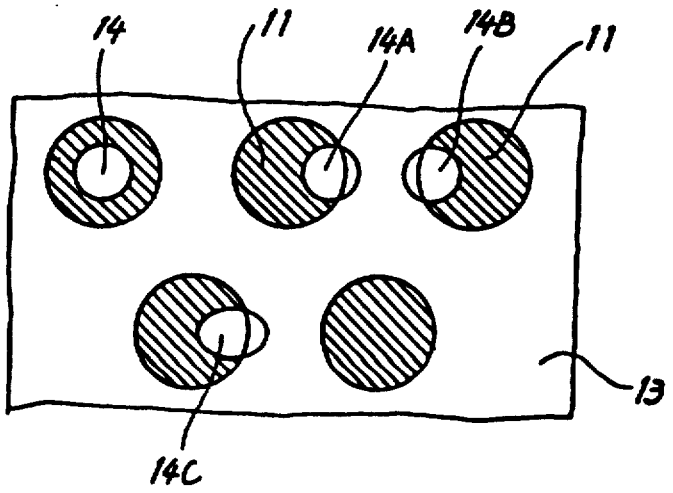
FIG. 7 PRIOR ART
FIG. 7 is an enlarged fragmentary view of a fluorescent screen as irradiated with beams by a conventional apparatus.
Figure 8:
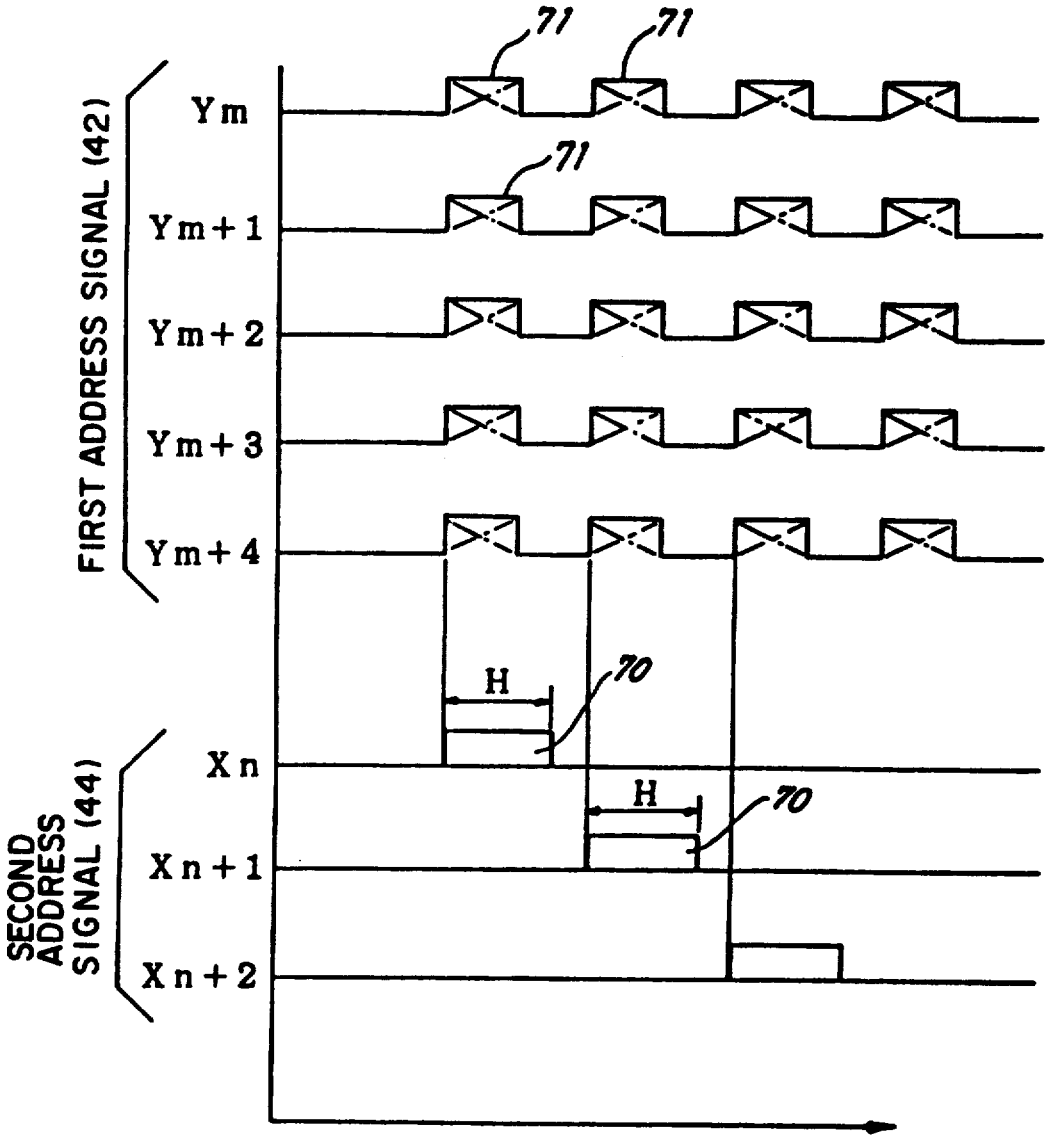
FIG. 8 PRIOR ART
FIG. 8 is a diagram of the signals to be applied to the first and second address electrodes of a conventional apparatus.

In an A/D conversion-image memory circuit 81, a video signal is sampled with the rise of a sampling signal 82 as seen in FIG. 6, affording a quantized N-bit signal.

A correction data circuit 91 produces an N-bit correction data signal representing a specified fixed value as timed with the image data signal.

A data switcher 92 selects one of the image data signal and the correction data signal of the same N bits and feeds the signal to the data-side electrode control-drive circuit 6.

The correction signal circuit 9 includes a data change signal-data transfer signal generator circuit 93, which receives a sampling signal, horizontal scan change signal and field change signal from a timing control circuit 80 to deliver a data change signal 94 and a data transfer signal.

As shown in FIG. 6, the data change signal 94 is obtained by subjecting the sampling signal 82 to ½ frequency division. When the signal 94 is high, the data switcher 92 is changed over to a first channel ch1 to feed the image data signal to the data-side electrode control-drive circuit 6.

When the data change signal is low, the data switcher 92 is changed over to a second channel ch0 to feed the correction data signal to the circuit 6. Accordingly, the image data signal and the correction data signal appear alternately with time as the input data to the circuit 6. With the rise of the data transfer signal (synchronized with the sampling signal and reverse thereto in phase), the input data signal is transferred to the shift register of the control-drive circuit 6. The data which has been transferred within the (n−1)th period H is latched by a latching signal from the timing control circuit 80 upon completion of the (n−1)th period H, and delivered from the shift register to the first address electrodes 42 during the next nth period H.

When images are presented by the interlaced scanning system, the operation of the data switcher 92 is controlled by the field change signal from the timing control circuit 80, and the order of the image signal and the correction signal for the first address electrodes 42 is changed from field to field.

Figure 3:
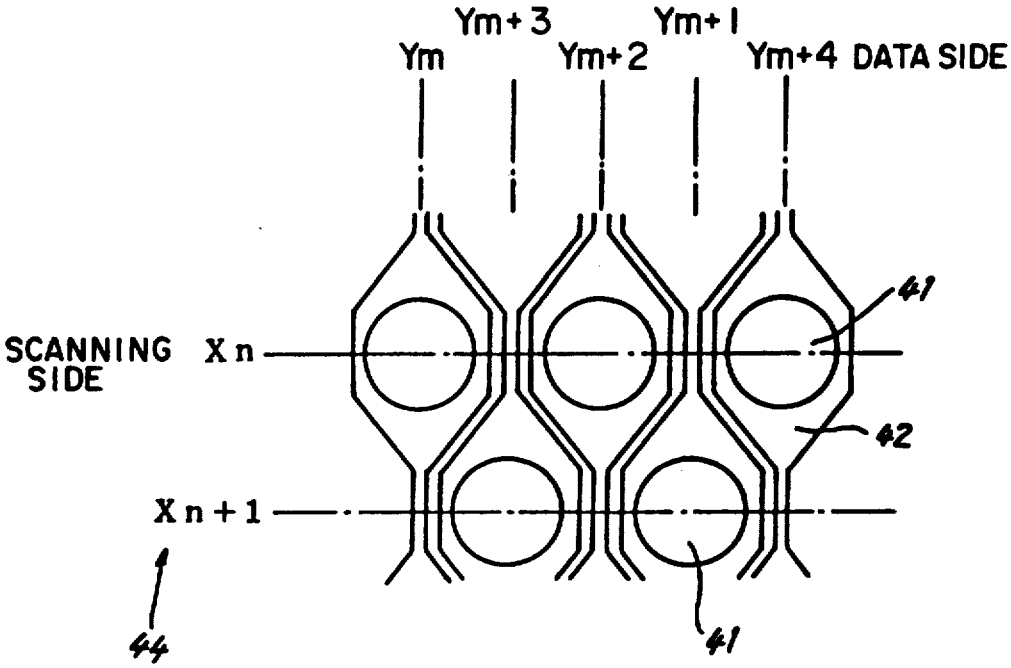
FIG. 3 is an enlarged plan view of an address electrode board showing the configuration of the first address electrodes and the arrangement of apertures.

With reference to the mth and the following first address electrodes 42, i.e., the electrodes $Y_m$, $Y_{m+1}$, . . . , shown in FIG. 3, it is assumed that the scanning signal voltage is applied to the nth electrode $X_n$ among the second address electrodes 44. At this moment, the electrodes 42 receiving the image signal 71 and those receiving the correction signal 72 are arranged alternately as illustrated according to the invention described. Further when attention is directed to the mth first address electrode $Y_m$, it is seen that the image signal 71 and the correction signal 72 are applied to the electrode alternately with the lapse of time.

Thus, in the group of first address electrodes 42, the correction signal is applied to the electrodes not participating in controlling electron beams during a certain horizontal scanning period, so that the electron beams will not be deflected. Moreover, the voltage of the correction signal, which elevates the average electrode potential of the overall assembly of first address electrodes 42, permits the cathode to release electrons with greater ease and is therefore effective for producing images of improved sharpness and higher luminance.

The present invention is not limited to the construction of the foregoing embodiment but can of course be modified variously by one skilled in the art within the scope of the invention as defined in the appended claims.

What is claimed is:

1. A flat display, comprising:

a front panel having a fluorescent screen on a rear surface thereof with phosphor dots being arranged in a delta pattern;

a rear panel opposed to the front panel in parallel thereto and defining a closed flat space along with the front panel;

a cathode provided on an inner surface of the rear panel;

an address electrode board interposed between the cathode and the front panel, wherein the address electrode board includes a plurality of first address electrodes extending in parallel to one another on one surface of a substrate in the form of a flat plate, and a plurality of second address electrodes arranged on the other surface of the substrate and extending in parallel to one another in a direction intersecting the first address electrodes, wherein the address electrode board includes at least one aperture formed in each of the portions thereof where the first address electrodes are lapped over the second address electrodes with the substrate provided therebetween in a delta pattern and a driving means for driving the electrodes of the flat display, wherein the driving means comprises a scanning-side control-drive circuit connected to the second address electrodes on the scanning side of the address electrode board for applying a horizontal scanning signal voltage to the scanning-side electrodes successively, a data-side control-drive circuit connected to the first address electrodes on the data side of the board for applying an image signal to every other data-side address electrode, and a correction signal circuit for applying a correction voltage signal of a specified fixed voltage value to the first address electrodes on opposite sides of each first address electrode receiving the image signal so that for every scan with each scanning-side address electrode, the image signal and the correction signal are alternately applied to the data-side address electrodes upon a changeover of the connection thereto.

2. A flat display as defined in claim 1, wherein when the driving means is an interlaced system, the correction signal circuit receives a field change signal to change the order of the image signal and the correction signal for the data-side address electrodes from field to field.

3. A method for driving electrodes of a flat display, said flat display including a front panel having a fluorescent screen on rear surface thereof with phosphor dots being arranged in a delta pattern, a rear panel opposed to the front panel in parallel thereto and defining a closed flat space along with the front panel, a cathode provided on the inner surface of the rear panel, and an address electrode board interposed between the cathode and the front panel, wherein the address electrode board includes a plurality of first address electrodes extending in parallel to one another on one surface of a substrate in the form of a flat plate, and a plurality of second address electrodes arranged on the other surface of the substrate and extending in parallel to one another in a direction intersecting the first address electrodes, the address electrode board having at least one aperture formed in each of the portions thereof where the first address electrodes are lapped over the second address electrodes with the substrate provided therebetween in a delta pattern, the method comprising the steps of:

driving the electrodes of the flat display by applying an image signal to every other first address electrode on a data side of the address electrode board;

applying a correction voltage signal of a specified fixed voltage to the first address electrodes on opposite sides of each first address electrode receiving the image signal; and alternately applying the image signal and the correction signal as replaced by each other to the data-side address electrodes for every horizontal scan.

4. A method as defined in claim 3, wherein when the step of driving the electrodes includes the step of driving the electrodes by an interlaced system, the image signal and the correction signal are applied to the data-side address electrodes upon a change of the order of the signals every time a field change signal is produced.

* * * * *